US007841882B2

(12) United States Patent
Antonini et al.

(10) Patent No.: US 7,841,882 B2
(45) Date of Patent: Nov. 30, 2010

(54) MICRO GANGMATE MULTI-PORT MODULAR RF CARD EDGE CONNECTOR

(75) Inventors: Gino S. Antonini, New Fairfield, CT (US); Owen R. Barthelmes, Putnam Valley, NY (US); Michael A. Hoyack, Sandy Hook, CT (US); David I. Weinstein, Yorktown Heights, NY (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 12/369,442

(22) Filed: Feb. 11, 2009

(65) Prior Publication Data

US 2010/0203761 A1 Aug. 12, 2010

(51) Int. Cl.
*H01R 13/62* (2006.01)

(52) U.S. Cl. ..... 439/329; 439/839

(58) Field of Classification Search ..... 439/329, 439/493, 497, 260, 630, 637, 839
See application file for complete search history.

(56) References Cited

U.S. PATENT DOCUMENTS 3,579,283 A * 5/1971 Welburn ..... 439/325
4,253,719 A * 3/1981 McGinley ..... 439/329

* cited by examiner

*Primary Examiner*—Javaid Nasri
(74) *Attorney, Agent, or Firm*—Blank Rome LLP

(57) ABSTRACT

A connector assembly includes: at least one signal contact adapted to terminate at least one conductor of a cable; at least one terminal adapted to receive the at least one signal contact; a housing including a channel configured to receive the at least one terminal and adapted to receive at least a portion of a printed circuit board; and a biasing member adapted to bias the at least one terminal against the circuit board, thereby pressing the at least one signal contact against the circuit board to inhibit horizontal movement of the at least one signal contact relative to the at least a portion of a printed circuit board.

17 Claims, 12 Drawing Sheets

MICRO GANGMATE MULTI-PORT MODULAR RF CARD EDGE CONNECTOR

FIELD OF THE INVENTION

The present invention relates to connectors for use in wireless applications. In particular, the present invention relates to connectors for use in connecting wireless radio cards with wireless antennas.

BACKGROUND OF THE INVENTION

As the rate of information exchange continues to increase, the use of wireless communications also continues to increase. In the past, notebook computers (sometimes referred to as "laptop computers") have used wireless device cards to communicate information over varying bandwidths. Typically, every different bandwidth requires an individual wireless card. Each wireless card interfaces with an antenna to distribute its information. This interface is usually achieved by a connector. The most common configuration of connector is adapted to connect anywhere from one to three cards to one to three antennas. When more than three cards and antennas are required, signal routing becomes exceedingly difficult.

In particular, the existing connector solutions are too large to fit in the space reserved for interconnect on typical cards. Additionally, incorrect connections are possible due to the close proximity of connectors positioned without keying or marking.

Existing connector solutions require two right angle transitions between the cable and the PC board. This configuration increases the loss of the RF signal, especially at the higher frequencies of new communication bands (e.g., up to 8 GHz).

Due to the difficulties outlined above with routing the signals for multiple cards through a single connector, multiple connectors have been required to enable all of the wireless applications. However, at the same time that wireless applications are expanding, notebook computers are shrinking in size. The reduction in available space for wireless cards, antennas, and their connectors mandates improved connectors that are capable of accommodating more than three cards at one time.

SUMMARY OF THE INVENTION

In light of the foregoing difficulties of the background art, non-limiting aspects of the present invention provide: a connector assembly that includes at least one signal contact adapted to terminate at least one conductor of a cable; at least one terminal adapted to receive the at least one signal contact; a housing including a channel configured to receive the at least one terminal and adapted to receive at least a portion of a printed circuit board; and means for biasing the at least one terminal against the circuit board, thereby pressing the at least one signal contact against the circuit board to inhibit horizontal movement of the at least one signal contact relative to the at least a portion of a printed circuit board.

DESCRIPTION OF THE EMBODIMENTS

These and other objects of the invention, as well as many of the intended advantages thereof, will become more readily apparent when reference is made to the following description, taken in conjunction with the accompanying drawings.

Figure 1:
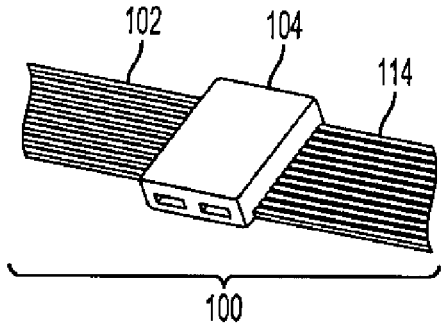
FIG. 1 illustrates a non-limiting embodiment of the gangmate connector of the present invention.
Figure 1A:
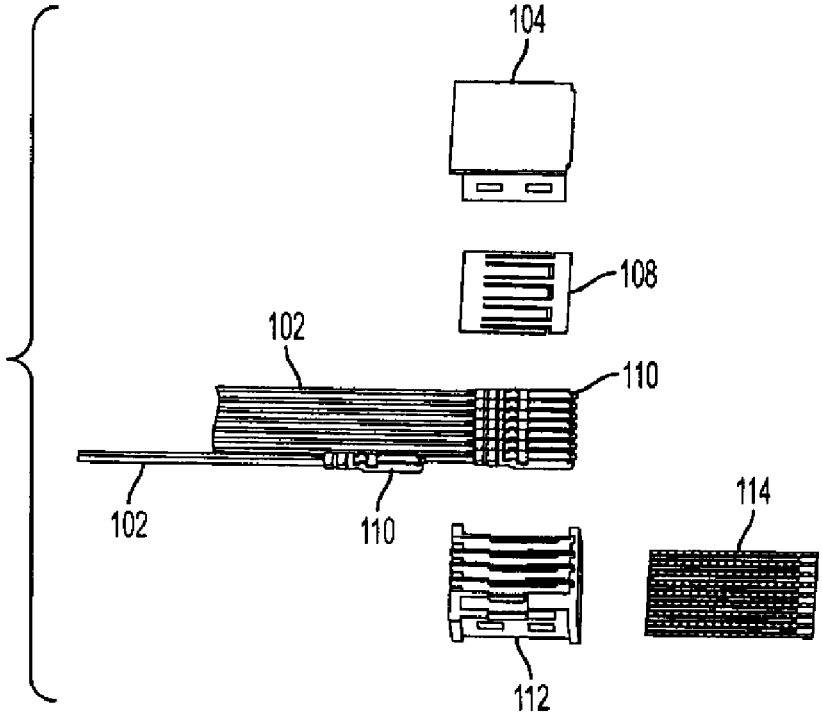
FIG. 1A provides an expanded view of the gangmate connector of FIG. 1.

With reference to FIGS. 1 and 1A, non-limiting aspects of the invention provide a connector assembly 100, in which cable 102 is connected to PC board 114 inside housing cover 104. As shown in more detail in FIG. 1A, cable 102 is connected to RF connector 110. Spring 108 is positioned above connector 110 to apply pressure to connector 110 within the housing cover 104. Housing 112 is positioned underneath connector 110, such that a channel is formed between the housing 112 and the connector 110. PC board 114 is then inserted into that channel to complete the connection between the cable 102 and the PC board 114. Through this configuration, it is possible to prohibit horizontal movement of the cable 102 relative to the PC board 114, which enables improved signal transmission between the cable 102 and the PC board 114. Additionally, connector 110 launches to the edge of a PC board, which results in a smooth and direct transition from the cable to the PC board.

Although horizontal movement is inhibited, vertical movement is allowed. The vertical movement is a beneficial feature of the grounding system of the present invention. For example, it enables the use of a rigid shield ground body, as opposed to individual spring contacts. The vertical movement along with the shared ground spring replaces individual spring contacts. This, in turn, simplifies the construction, allows for more modular configuration, and improves RF shielding.

Figure 2:
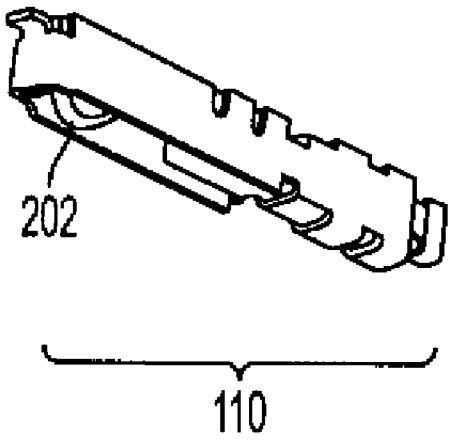
FIG. 2 illustrates an RF connector according to non-limiting aspects of the present inventions.
Figure 3:
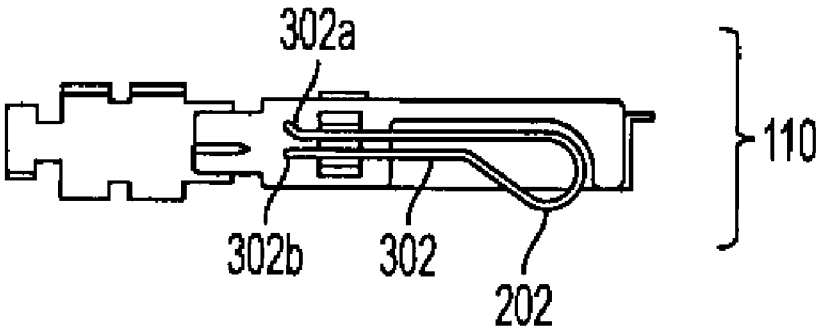
FIG. 3 provides a side cross-sectional view of the connector illustrated in FIG. 2.

FIGS. 2 and 3 illustrate non-limiting examples of a compression version of RF connector 110 according to aspects of the present invention. As illustrated in FIGS. 2 and 3, PCB contact point 202 protrudes below the bottom of RF connector 110 in order to contact traces on a PC board. That protrusion enables the RF connector 110 to form a connection between the cable 102 and PC board 114.

In more detail, signal contact 302, which may be formed from a loop of metal, a metal coated non-metal, or another suitable material, may include two tines 302*a* and 302*b* at the respective ends of the loops. The two tines 302*a* and 302*b* form a compression connection with a conductor (not shown) of the cable 102. In the embodiment shown in FIGS. 2 and 3, the signal contact 302 rests within a cavity of the RF connector 110. However, other configurations are within the scope of the present invention.

To assemble the connector 110, the cables 102 are terminated to an individual RF connector 110 (sometimes called an "RF contact"), and each RF connector 110 is inserted into the appropriate cavity in the housing 112. Spring member 108 is positioned on top of the RF connectors 110 and the top cover 104 is assembled and captivated to the bottom housing 112.

Figure 4:
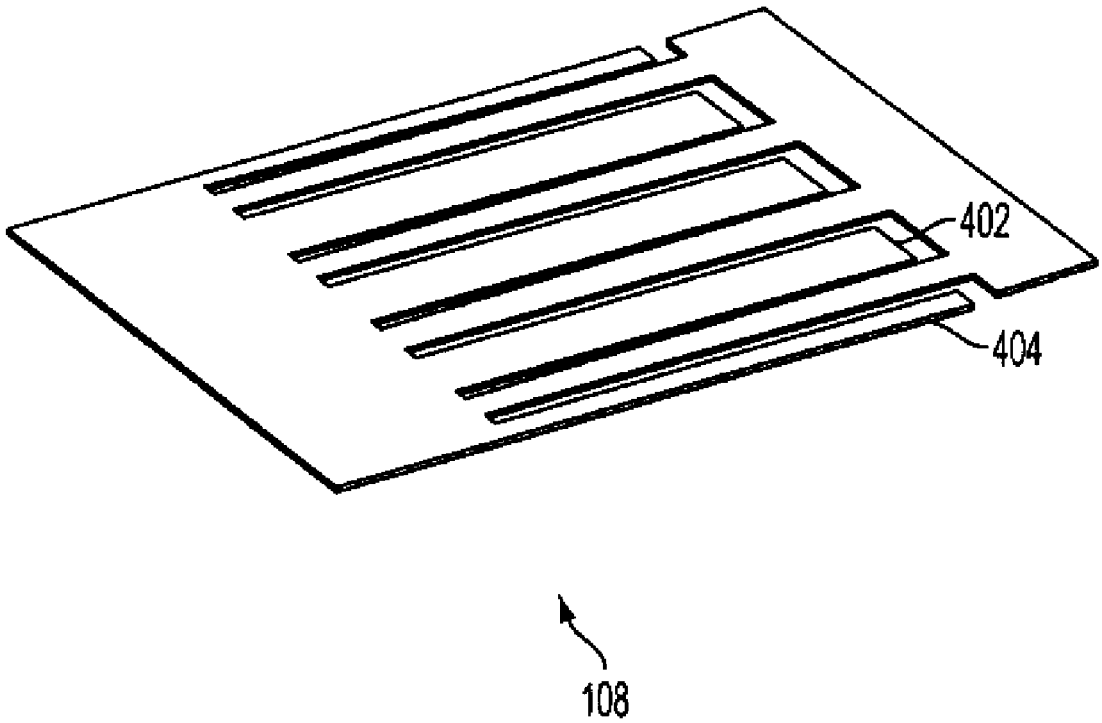
FIG. 4 provides an exemplary illustration of a spring according to non-limiting aspects of the present invention.

FIG. 4 illustrates spring member 108 with more particularity. As is evident from FIG. 4, spring member 108 may include two types of springs: grounding spring 404 and biasing spring 402. Both grounding spring 404 and biasing spring 402 apply a force to the RF connector 110. That is, the spring member applies force to the individual RF connectors. The force applied by spring member 108 inhibits horizontal movement between the RF connector 110 and the PC board 114. However, spring member 108 may be fabricated as a single element. In other words, there is no requirement that the spring member 108 include two separate spring elements.

Figure 5:
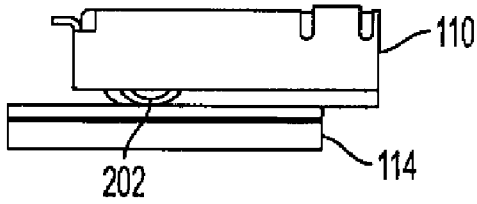
FIG. 5 is a side view of a connector mating with a circuit board according to the present invention.

FIG. 5 provides another illustration of the RF connector 110 as it connects with a PC board 114. As the profile illustration shows, PCB contact point 202 protrudes below the RF connector 110 to connect with a trace (not shown) on PC board 114. In the non-limiting example of FIG. 5, the connector wall edge is flush and coplanar to PCB trace.

Figure 6:
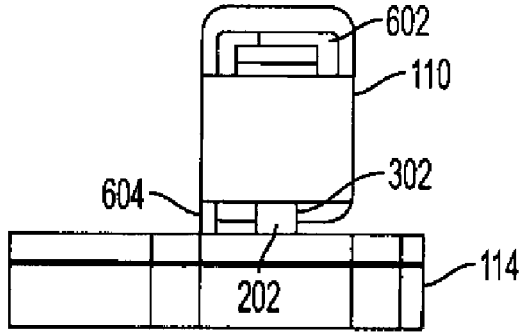
FIG. 6 provides a front view of a connector and circuit board according to non-limiting aspects of the present invention.

FIG. 6 shows a front view of the RF connector 110 mated with PC board 114. Signal contact 302 protrudes below so that PCB contact point 202 can mate with a trace (not shown) on PC board 114. Element 602 represents an insulative component that maintains the positions of the signal contact within the ground contact. The insulative component 602 may include a molded or machined clam shell, two piece insulator, or other suitable configuration. The insulative component provides a mechanical separation between the signal and ground contact. This separation enables correct and controlled impedance through the connector. Proper impedance in an RF connector ensures low loss signal transmission.

As a non-limiting alternative, the RF connector 110 may include extended wall 604. The wall may extend on either side of PC connector 110. Although only one wall is shown as extended, it is of course possible to have any configuration of extended walls (one, two, three, or four).

Figure 7:
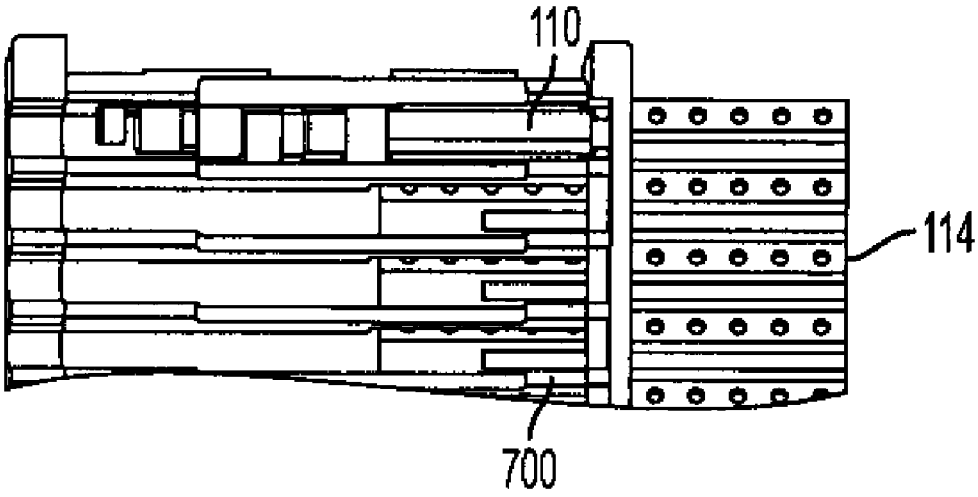
FIG. 7 illustrates a non-limiting embodiment of a housing with an engaged connector and a printed circuit board according to the present invention.

FIG. 7 illustrates a partially assembled gangmate assembly according to the present invention. PC board 114 is illustrated as inserted into the gangmate 700. As shown, RF connector 110 may be inserted into gangmate 700. In the non-limiting example of FIG. 7, four RF connector positions are illustrated in the gangmate 700. However, other configurations are possible. For example, the gangmate may be configured to accommodate as many connectors as desired. Using the gangmate connectors, it is possible to greatly minimize the space required for multiple wireless applications while protecting the integrity of the signal connections. Also, in the non-limiting example of FIG. 7, the housing walls captivate connector allowing only vertical movement.

Figure 8:
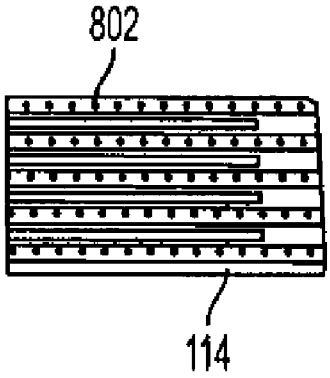
FIG. 8 illustrates a printed circuit board according to a non-limiting aspect of the present invention.
Figure 9:
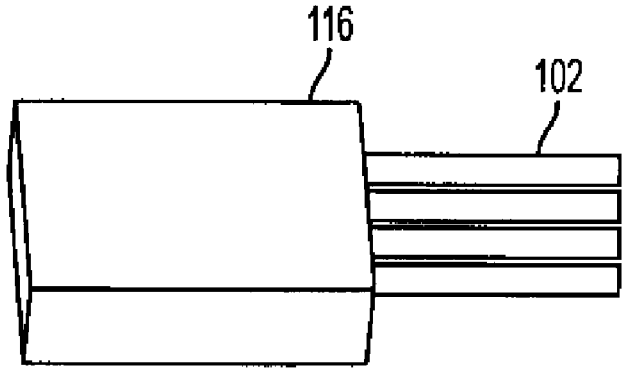
FIG. 9 illustrates an exemplary assembled multi-port gangmate according to non-limiting aspects of the present invention.

FIG. 8 provides a more detailed illustration of PC board 114. As shown in FIG. 8, traces 802 are present on the surface of PC board 802. Traces 802 may be mated with PCB contact point 202 to form an electrical connection. FIG. 9 shows an exemplary housing 116, into which a cable 102 has been inserted.

Figure 10:
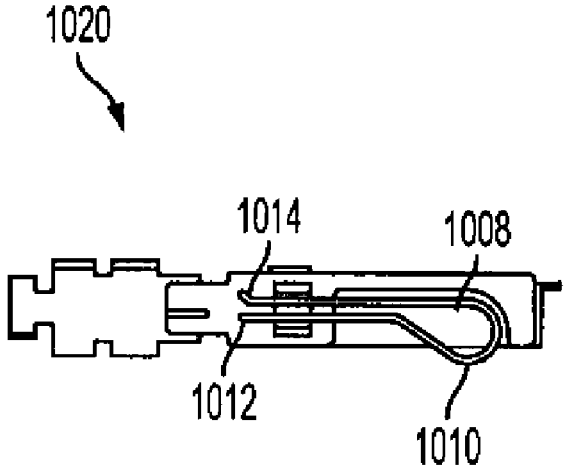
FIG. 10 illustrates an exemplary compression version of a connector according to the invention.
Figure 11:
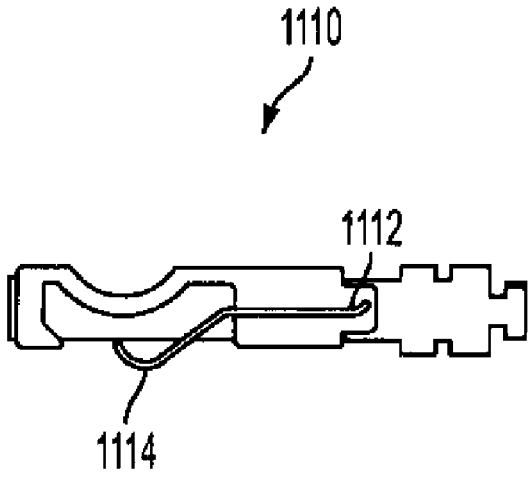
FIG. 11 illustrates an exemplary solder version of a connector according to the present invention.

FIGS. 10 and 11 provide examples of alternative embodiments of the RF connectors according to the present invention. As shown in FIGS. 10 and 11, the RF connectors may include a compression version (FIG. 10) or a solder version (FIG. 11). The compression version of RF connector 1020 may include a looped piece of metal 1008. Tines 1012 and 1014 form a compression connection with a conductor in a cable (not shown). PCB contact 1010, which may protrude below the connector 1020, is adapted to mate with a trace on the PC board (not shown). In the non-limiting example of FIG. 10, the cable center conductor is compressed between the 2 tines of the signal contact when insulators are squeezed together during cable assembly.

In the solder version of FIG. 11, the single tine contact has the cable center contact soldered onto the tine. This configuration may be desirable where simplicity is required. PCB contact 1114 is adapted to mate with a trace on a PC board (not shown). While the examples herein describe one tine in the solder version and two tines in the compression version, other configurations are within the scope of this invention. Tine 1112 forms a contact with a conductor in a cable (not shown) by soldering the cable center conductor to the tine (e.g., at the rear of the tine). The contact material may be made from a material with spring like properties, which enables improved contact. The contact may be also be configured to have an interference fit with the printed circuit board that uses the spring force from the material. In the non-limiting example of FIG. 11, the cable center conductor is soldered to the single tine of the signal contact before squeezing the insulators together during cable assembly.

Figure 12:
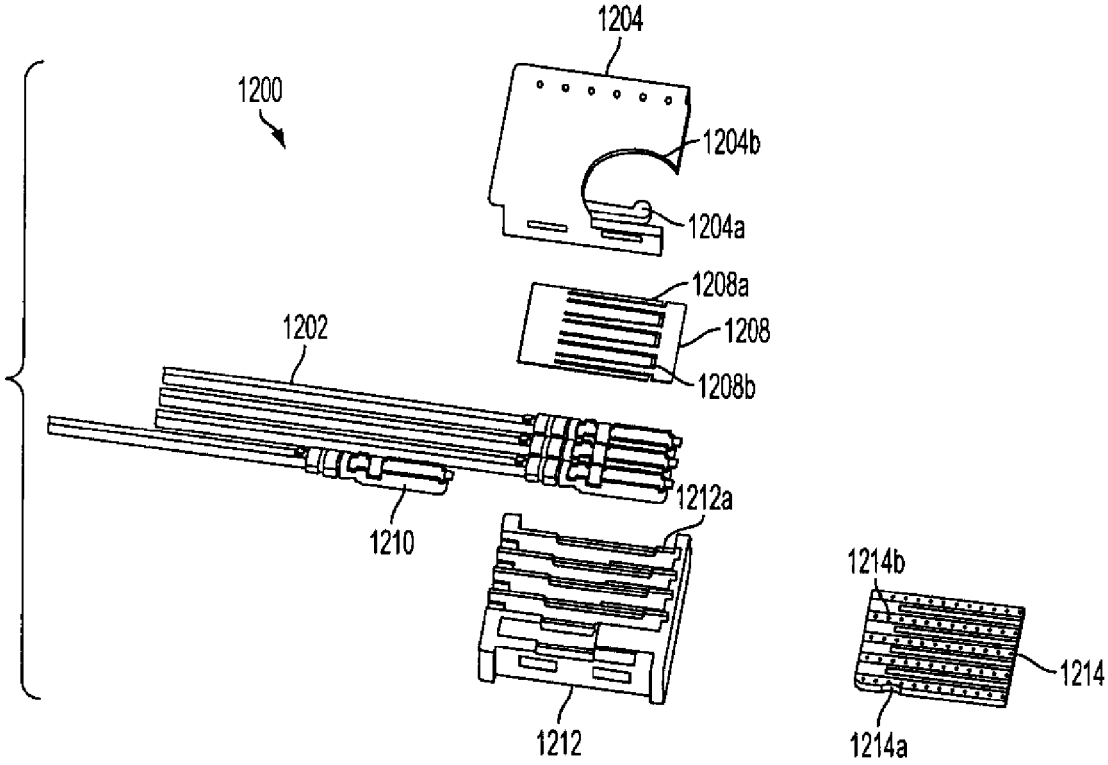
FIG. 12 provides a non-limiting example of another gangmate according to the present invention.

FIG. 12 provides a non-limiting illustration of a gangmate assembly 1200 according to an alternative embodiment of the invention. As shown in FIG. 12, gangmate assembly 1200 includes RF connector 1210, spring member 1208, housing cover 1204, and housing 1212. Housing 1212 is adapted to receive printed circuit board 1214. Printed circuit board 1214 includes latch notch 1214*a*, which is adapted to receive latching mechanism 1204*a* in housing cover 1204.

Housing 1212 includes channels 1212*a*, which are adapted to receive RF connectors 1210. Through the configuration illustrated in FIG. 12, RF connectors 1210 are easily isolated and supported to maintain good connections with traces 1214*b* on printed circuit board 1214.

Also, as shown in FIG. 12, spring member 1208 includes grounding spring 1208*a* and biasing spring 1208*b*. As described above, biasing spring 1208*b* and grounding spring 1208*a* are configured to apply pressure to RF connector 1210. The pressure applied by spring member 1208 inhibits horizontal movement of the RF connector 1210 relative to PC board 1214. As described above, this enables improved electrical connections between cable 1202, RF connector 1210, and the PC board 1214.

As shown in detail in FIG. 12 via cutaway portion 1204*b* of housing cover 1204, housing cover 1204 may include a latching mechanism 1204*a*. The precise configuration of latching mechanism 1204*a* is not critical, and any configuration suitable for interfacing with the latch notch 1214*a* in the printed circuit board 1214 is within the scope of the present invention.

Figure 13:
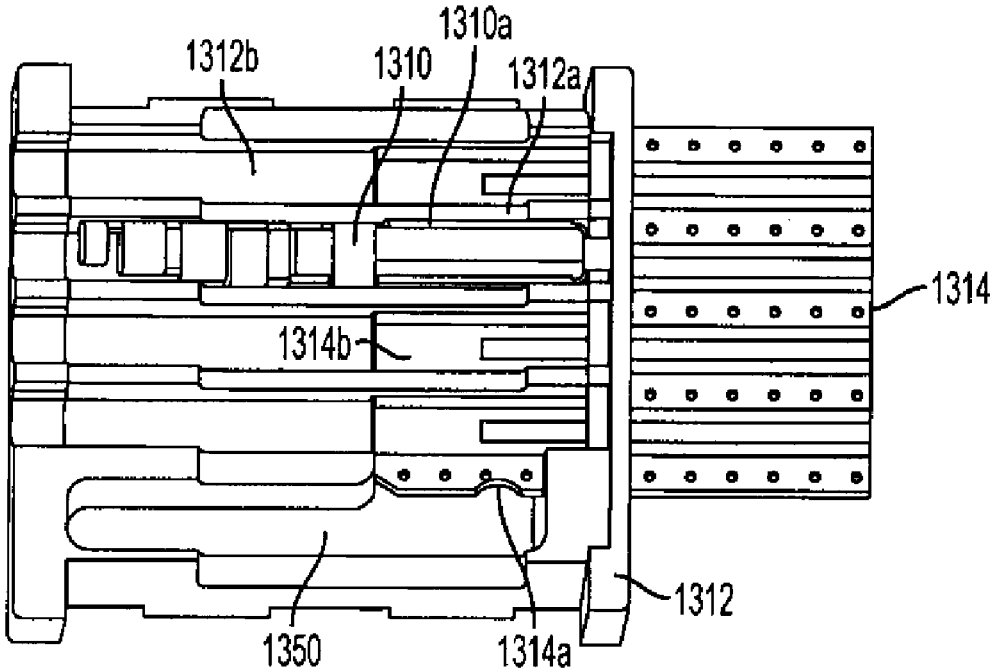
FIG. 13 provides a more detailed view of an exemplary housing according to non-limiting aspects of the invention.

FIG. 13 provides a more detailed view of an exemplary housing according to non-limiting aspects of the invention. As shown in FIG. 13, RF connector 1310 is inserted into housing 1312 to form an electrical connection with traces 1314*b* on PC board 1314. The walls 1310*a* of RF connector 1310 may be of varying lengths, as described above with respect to FIG. 6. Wall 1312*a* of channel 1312*b* enable secure positioning of RF connector 1310. Additionally latch arm cavity 1350 enables secure mating of a latching mechanism (e.g., latching mechanism 1204*a* in FIG. 12) with latch notch 1314*a* of the PC board 1314. As shown in FIG. 13, the housing walls captivate the RF connector allowing only vertical movement.

Figure 14B:
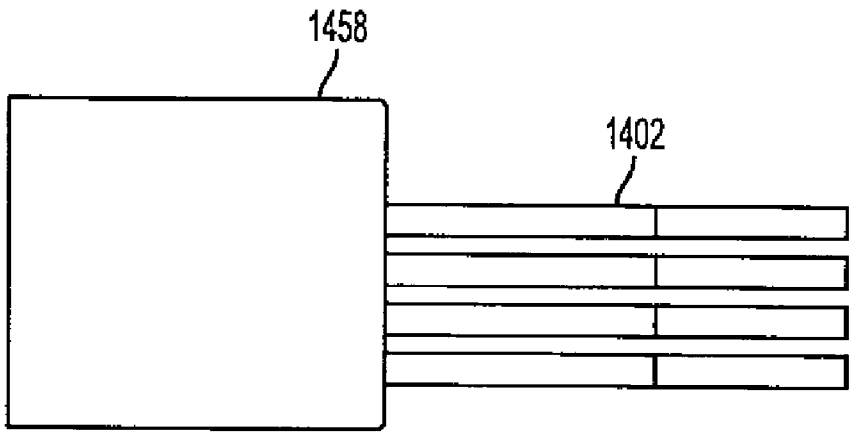
FIGS. 14A and 14B illustrate yet another non-limiting mating configuration of the present invention.
Figure 14A:
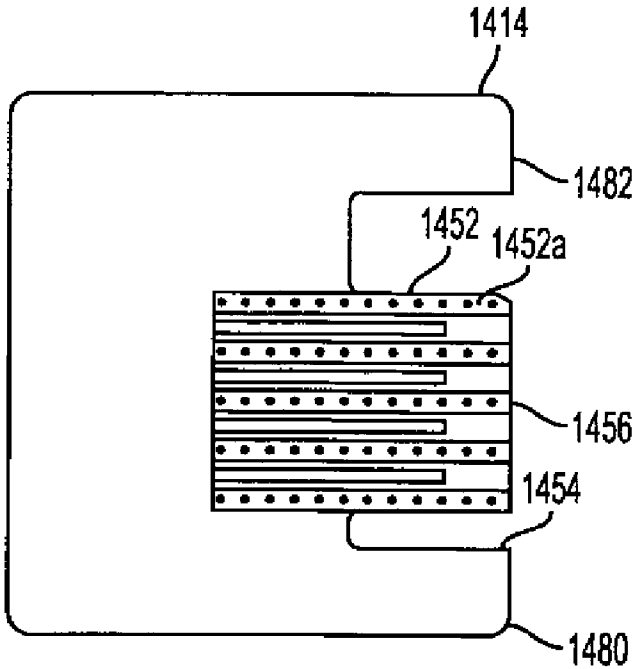

FIG. 14 represents another non-limiting embodiment of the present invention. The embodiment of FIG. 14 may be incorporated into any of the other embodiments of the present invention, if desired. As shown in FIG. 14, PC board 1414 includes recessed areas 1452 and 1454. These recessed areas enable the printed area 1456 to more easily mate with the RF connector (not shown). The PC board 1414 may also include a latch notch 1452*a*, if desired.

The printed area 1456 is introduced into the multiport edge connector 1458 so that edges 1480 and 1482 of the PC board 1414 protrude about the sides of the connector 1458. Cable 1402, inserted into the connector 1458, may then form an electrical connection with PC board 1414 via RF connectors (not shown).

Figure 15C:
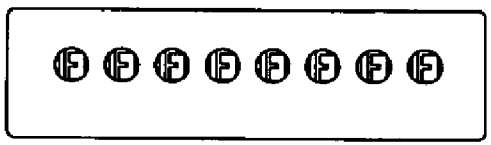
FIGS. 15A to 15D respectively show the front view, the side view and the rear view of the 8 position connector, and the mating printed circuit board.
Figure 15B:
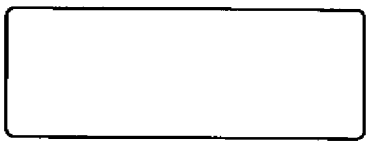
Figure 15D:
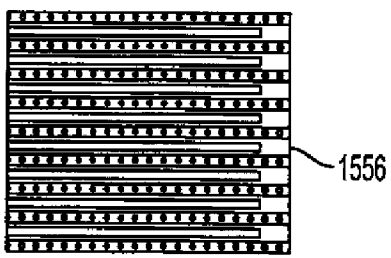
Figure 15A:
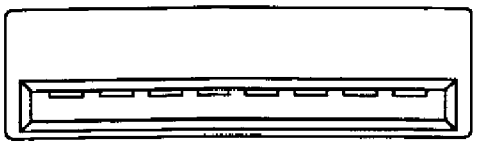
Figure 16C:
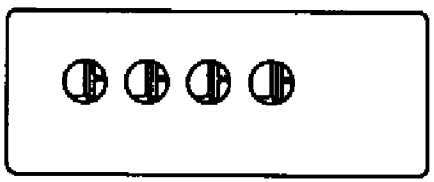
FIGS. 16A to 16D respectively show the front view, the side view and the rear view of the 4 position connector, and the mating printed circuit board.
Figure 16B:
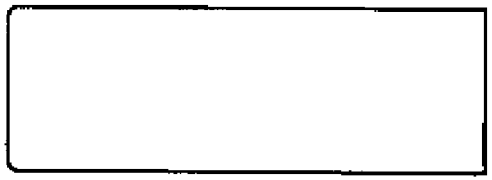
Figure 16D:
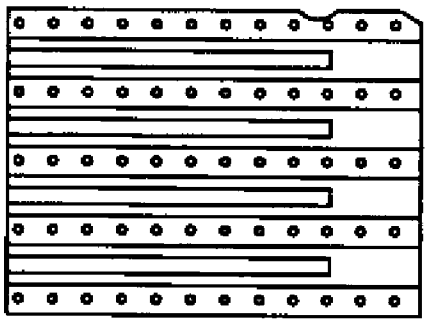
Figure 16A:
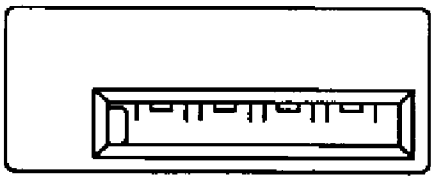

FIGS. 15A to 15D respectively show the front view, the side view and the rear view of the 8 position connector, and the mating printed circuit board or PCB interface. The port shown in FIG. 15A is used for receiving the PC board and the 8 ports in FIG. 15C are used for receiving the cables. FIGS. 16A to 16D respectively show the front view, the side view and the rear view of the 4 position connector, and the mating printed circuit board. The port shown in FIG. 16A is used for receiving the PC board and the 4 ports in FIG. 16C are used for receiving the cables.

The outer body of the RF connector may be made of spring metal alloy or other suitable material. Insulators may be made from a plastic material or other insulative material. The grounding spring may also be made of spring metal alloy. The housing components may be made of a plastic material, or other suitable material, and may incorporate a metal shell for increased robustness.

The connector described herein has numerous benefits. For example, it requires less real estate on the printed circuit board. It also may include numbered signal lines to prevent mis-matings. In effect, the present invention eliminates half of the connectors currently being used by mating directly to the PC board. It may be adapted to operate to 8 GHz, and all positions may be mated simultaneously, thereby reducing assembly labor. Optionally, the connector may be keyed and may provide a tactile feedback when mated.

To prevent signal interference, one side of the connector may be longer so that it touches a grounding trace. By placing the connectors side by side, the longer body may also create a shield (e.g., by having at least two connectors, they will shield each other). The long side of the connector also guarantees a coplanar contact with the grounding trace on the PC board.

Another non-limiting aspect of the invention provides a connector adapted to use both sides of the PC board with a full duplicate set of cables and contacts. Yet another aspect provides power or signal contacts in place of one or more RF contacts (hybrid).

While the non-limiting examples described above include a spring element to apply the vertical pressure and therefore contact force, other configurations are possible. Additionally, the spring may be molded as part of the connector housing and/or made of plastic.

The primary purpose of the spring member is to provide a force to maintain good contact between the individual connector body and the PC board. The spring member does not need to be made of metal and does not need to ground the connector bodies to each other, as its primary function is to provide a spring force. However, such a configuration is within the scope of the present invention. Ideally, the spring member may be positioned such that it is captivated by the housing cover directly over the RF connectors so that it can exert a force on each.

The gangmate connector described herein is particularly useful for notebook computers and sub-components. Notebooks are provisioned to communicate to various wireless networks including mobile 3G, WiFi, and others. They are typically configured with radio cards (PC boards) that connect to the mother board. The radio cards communicate with the various wireless bands. Each radio card typically has at least one connector to connect to a coaxial RF cable which runs to an antenna which is mounted behind the LCD screen. This new connector concept would replace the connection to the radio card, especially in an application with three or more antenna lines. The cables described herein are most typically connected to an antenna, but could also be routed to another printed circuit board to perform some other function to the signal.

Obviously, numerous modifications and variations of the present invention are possible in light of the above teachings. It is therefore to be understood that within the scope of the appended claims, the invention may be practiced otherwise than as specifically described herein.

What is claimed is:

1. A connector assembly, comprising:

at least one signal contact adapted to terminate at least one conductor of a cable;

at least one terminal adapted to receive the at least one signal contact;

a housing including a channel configured to receive the at least one terminal and adapted to receive at least a portion of a printed circuit board; and a biasing member adapted to bias the at least one terminal against the printed circuit board, the terminal being disposed between the biasing member and the at least a portion of the printed circuit board, thereby pressing the at least one signal contact against the printed circuit board to inhibit horizontal movement of the at least one signal contact relative to the at least a portion of the printed circuit board.

2. The connector assembly according to claim 1, wherein the biasing member includes at least one spring.

3. The connector assembly according to claim 1, further comprising a housing cover.

4. The connector assembly according to claim 3, wherein the housing cover includes at least one latch mechanism.

5. The connector assembly according to claim 4, wherein the printed circuit board includes at least one latch notch adapted to receive the at least one latch mechanism.

6. The connector assembly according to claim 1, wherein the at least one terminal includes an RF connector.

7. The connector assembly according to claim 6, wherein the RF connector includes a means for electrically connecting the at least one signal contact and the at least one portion of the printed circuit board.

8. The connector assembly according to claim 7, wherein the means for electrically connecting the at least one signal contact includes at least one of a soldered connection and a contact connection.

9. The connector assembly according to claim 6, wherein the RF connector includes at least a first wall and a second wall, the first wall having a first height and the second wall having a second height.

10. The connector assembly according to claim 9, wherein the first height is different from the second height.

11. The connector assembly according to claim 9, wherein at least one of the first wall and the second wall provides a means for grounding.

12. The connector assembly according to claim 1, wherein the housing is comprised at least in part of a plastic.

13. The connector assembly according to claim 1, wherein the biasing member is comprised at least in part of a metal or a metal alloy.

14. The connector assembly according to claim 1, further comprising means for grounding.

15. The connector assembly according to claim 14, wherein the means for grounding includes at least one rigid shield ground body.

16. The connector assembly according to claim 1, wherein the biasing member is a single spring.

17. The connector assembly according to claim 16, wherein the biasing member is a conductive grounding spring.

* * * * *